United States Patent [19]

Ladd, Jr. et al.

[11] Patent Number: 4,630,955

[45] Date of Patent: Dec. 23, 1986

[54] COSMETIC POWDER DISPENSER AND APPLICATOR

[75] Inventors: James E. Ladd, Jr., Rowayton; David R. Jacobs, Norwalk, both of Conn.

[73] Assignee: Laura Lupton Inc., Rowayton, Conn.

[21] Appl. No.: 796,230

[22] Filed: Nov. 8, 1985

Related U.S. Application Data

[63] Continuation-in-part of Ser. No. 752,133, Jul. 5, 1985.

[51] Int. Cl.[4] ..... A46B 11/00; A46B 11/04

[52] U.S. Cl. ..... 401/123; 132/81; 132/82 R; 132/82 G; 401/99; 401/82; 401/125; 401/191; 401/270; 401/272

[58] Field of Search ..... 401/123, 124, 125, 126, 401/135, 191, 281, 79, 59, 117, 102, 99, 270, 272, 82; 132/81, 82 R, 82 G

[56] References Cited

U.S. PATENT DOCUMENTS

| | | | |
|---|---|---|---|
| 1,172,293 | 2/1916 | Kohlhepp | 132/82 G |
| 1,175,705 | 3/1916 | Ciai | 401/281 |
| 1,244,894 | 10/1917 | Renouf | 401/175 X |
| 2,240,876 | 5/1941 | Waterud | 401/281 X |
| 2,320,749 | 6/1943 | Pressentin | 401/175 |
| 2,480,331 | 8/1949 | Lecker | 401/125 |
| 2,545,091 | 3/1951 | Livermore | 401/117 X |
| 3,045,593 | 7/1962 | Petterson | 401/117 X |
| 3,565,540 | 2/1971 | Andrews | 401/135 X |

*Primary Examiner*—Steven A. Bratlie

[57] ABSTRACT

A first elongated hollow member has a first open end and an opposite closed end with a plurality of small spaced openings therein. A hollow elongated capsule, adapted to be filled with cosmetic powder, closed at one end and open at the other, is removably slidable into and out of the first member. The capsule, when inserted in the first member, has its open end adjacent the second end of the first member and its closed end closing the first end of the second member. A second elongated hollow member has first and second open ends, the first member having its closed end disposed in the first end of the second member. The second member has a cam in the first end with openings aligned with the openings in the closed end of the first member. The second member has a cam follower disposed slidably in the second member, the follower and said cam always being engaged, the follower and cam having a first normal position of engagement at which the follower seals the cam openings and a second momentary position of engagement at which the follower exposes the cam opening. A third elongated hollow member has an open end. A brush has a plurality of essentially parallel bristles with powder applying tips, the brush being disposed in the open third member end, the brush carrying end of the third member being disposed in the second end of the second member and engaging the follower. The second member is slidable back and forth along the third member between a first normal position at which the cam and follower are in the first position of engagement and a second momentary position at which the cam and follower are in the momentary second position of engagement.

5 Claims, 6 Drawing Figures

COSMETIC POWDER DISPENSER AND APPLICATOR

CROSS REFERENCE TO COPENDING APPLICATION

This application is a continuation-in-part of copending application entitled "Cosmetic Powder Dispenser and Applicator", filed July 5, 1985, Ser. No. 752,133 now allowed.

BACKGROUND OF THE INVENTION

The copending application Ser. No. 752,133 discloses a cosmetic powder dispenser and applicator in which first and second members have a first position of relative rotation at which openings in the two members are aligned and powder can flow through the aligned openings onto a brush for application by the user. These members have a second position of relative rotation at which this powder flow is blocked. The present invention is directed to this type of powder dispenser and applicator wherein the two members are not relatively rotatable, but instead, a mechanism is utilized wherein longitudinal movement is employed either to allow or to block powder flow.

SUMMARY OF THE INVENTION

In accordance with the principles of the invention, a cosmetic powder dispenser and applicator employs a first elongated hollow member having first and second opposite ends. The first end is open. The second end is closed and has a plurality of small spaced apart openings therein. An elongated capsule adapted to be filled with cosmetic powder is closed at one end and is open at the other. The capsule is removably slidable into and out of the first member. The capsule, when inserted in the first member, has its open end adjacent the second end of the first member and its closed end closing the first end of the first member.

A second elongated hollow member has first and second open ends with the closed end of the first member being disposed in the first end of the second member. The second member has a cam in its first end with openings aligned with the openings in the closed end of the first member. The second member has a cam follower disposed slidably therein. The cam and follower are always engaged. The cam and follower have a first normal position at which the follower seals the cam openings and a second momentary position of engagement at which the follower exposes the cam openings.

A third elongated hollow member has an open end in which a brush having bristles is inserted. The brush and third member have manually operated cooperating elements for establishing a forward position at which the bristles extend almost entirely out of the third member and a second withdrawn position at which the brush is disposed within the third member.

The brush carrying end of the third member is disposed removably in the second end of the second member and engages the cam follower. The second member is slidable back and forth along the third member between a first normal position at which the cam and follower are in the first position of engagement and a second momentary postion at which the cam and follower are in the momentary second position of engagement.

In use, the three members are disposed end to end and the dispenser and applicator is disposed vertically with the first member disposed above the third member, the brush being in withdrawn position in the third member. The cam and follower are in the normal first position and powder cannot fall onto the bristles of the brush. Then the first and third members are moved longitudinally toward each other, as for example holding the third member in fixed position while pushing downwardly on the first member. This action moves the second member longitudinally toward the third member, causing the cam and follower to be placed in the second position of engagement wherein the powder falls through the cam and follower onto the bristles. The third member can then be detached and the brush moved into the forward position to expose the bristles. By using the third member as a handle, the user can apply the powder as needed.

DETAILED DESCRIPTION OF PREFERRED EMBODIMENTS

Figure 2:
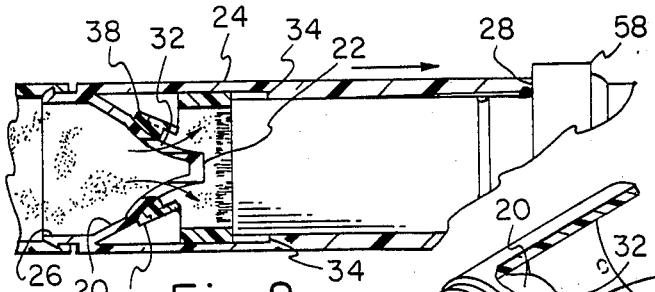
FIG. 2 is a longitudinal cross section of one of the major components of FIG. 1 showing the cam and follower in the momentary second position of engagement.
Figure 1:
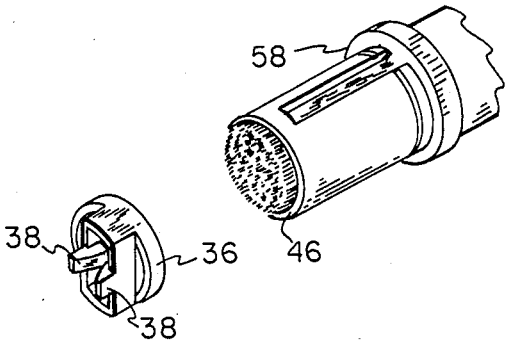
FIG. 1 is an exploded view illustrating one embodiment of the invention.
Figure 3:
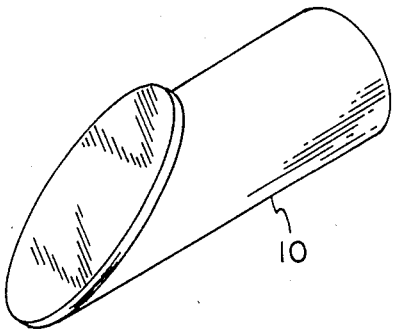
FIG. 3 is a view similar to that of FIG. 2 but showing the cam and follower in the first normal position of engagement.
Figure 3:
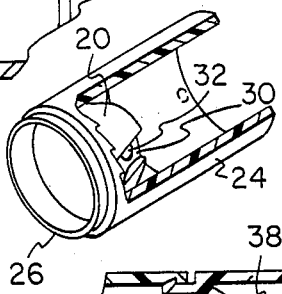
Figure 3:
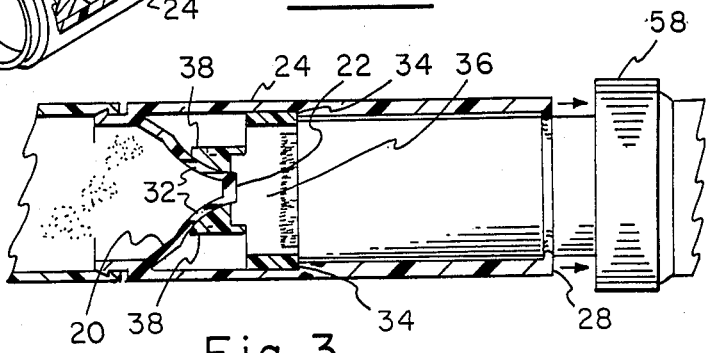
Figure 4:
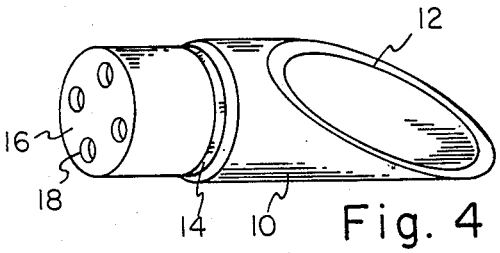
FIG. 4 is a detail view of another major component of the embodiment of FIG. 1.
Figure 4:
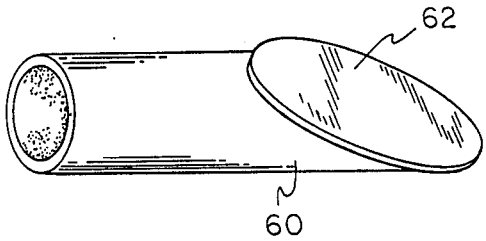
Figure 5:
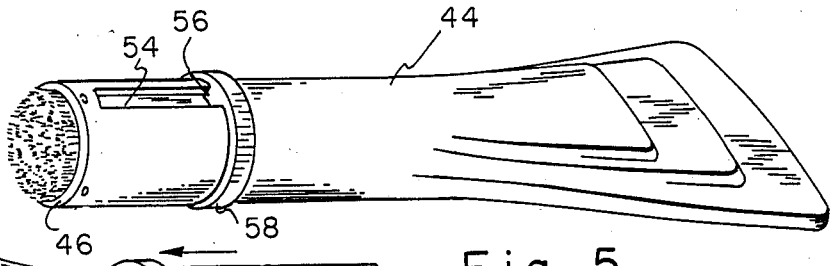
FIG. 5 is a detail view of yet another major component of the embodiment of FIG. 1, showing a brush in withdrawn position.
Figure 6:
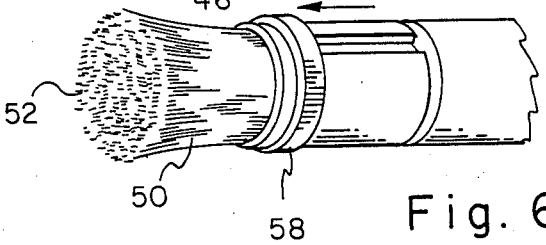
FIG. 6 is a detail view of a portion of the structure shown in FIG. 5, with the brush in extended position.

Referring to FIGS. 1–6, a first elongated hollow cylindrical plastic member 10 has one open end 12 which lies in a plane disposed at an acute angle with respect to the direction of elongation and has the shape of an ellipse. Member 10 has a shoulder 14 intermediate the ends and an extension of smaller diameter which terminates in the opposite end of this member. End 16 is closed and has a plurality of spaced apart small openings 18 therein.

A hollow elongated plastic capsule 60 can be filled with cosmetic powder and slidably and removably inserted into member 10 via its open end. The capsule has a closed transparent end 62 which meets the open end of member 10 in flush engagement. The opposite end of the capsule is open and abuts the opposite closed end of member 10. Since end 62 is transparent, the user can determine visually how much powder remains to be used.

A third hollow elongated plastic member 44 has one open end 46 and an opposite closed end. A brush 48 with substantially parallel bristles 50 having tips 52 is slidably disposed in the open end 46 of member 44. That portion of member 44 adjacent end 46 has two oppositely disposed longitudinally extending slots 54, only one of which is visible in the drawing.

The outer surface of the brush has two oppositely disposed elongated runners 56, each runner riding in a corresponding slot 54. The runners are secured at one end to ring 58 which is also the base for the bristles.

The brush can be slid forward so that the bristles are almost entirely exposed, or can be withdrawn so that the brush is disposed within the third member. The positions of the slots and runners are such that the brush is always secured to member 44 which can act as a brush handle.

A second hollow cylindrical member 24 has two opposite open ends 26 and 28. Member 24 engages extension 16 whereby end 26 abuts end 16. A plastic generally cone shaped hollow cam 20 is disposed in member 24 adjacent end 26. The cam has a longitudinal axis aligned with that of the member 24 and has a flattened tip or nose 22 which points toward the other end of member 24. The cam also has two oppositely disposed horizontal slots 30, each slot having an opening 32 aligned with a corresponding opening 18 of the first member.

Member 24 has a region of reduced diameter which extends from shoulder 34 to the opposite end 28. A plastic cam follower 36 is disposed in the member 24 and is slidable therein toward and away from the cam, the greatest separation being obtained when the follower bears against the shoulder 34. The follower has the shape of an open very shallow cylinder or ring with extensions supporting horizontal flexible arms 38. These arms always engage corresponding slots 30 of the cam. Normally the cam and follower are in a first position of engagement in which the follower abuts shoulder 34 and the arms cover the openings 32 in the slots.

However, the open end of the third member 44 extends slidably into end 26 until it engages the follower. The three members all have a common longitudinal axis. When a force of compression is applied along this axis between the first and third members, as for example, by holding the third member in place and applying the force to the first member, the second member moves toward the third member and the follower is moved closer to the cam. This action causes the arms to be forced further apart and to move further inward along the cam slots until the openings 32 are exposed. This is a momentary second position of engagement, since as soon as the compression force is released, the arms spring back to their original position, moving the follower further away from the cam and returning the cam and follower to the first normal position of engagement.

The dispenser and applicator can then be used in the manner previously described.

What is claimed is:

1. A cosmetic powder dispenser and applicator comprising:

a first elongated hollow member having a first open end and an opposite closed end with a plurality of small spaced openings therein;

a hollow elongated capsule, adapted to be filled with cosmetic powder, closed at one end and open at the other and removably slidable into and out of the first member, the capsule, when inserted in the first member, having its open end adjacent the second end of the first member and its closed end closing the first end of the second member;

a second elongated hollow member having first and second open ends, said first member having its closed end disposed in the first end of the second member, said second member having a cam in the first end having openings aligned with the openings in the closed end of the first member, said second member having a cam follower disposed slidably in the second member, said follower and said cam always being engaged, the follower and cam having a first normal position of engagement at which the follower seals the cam openings and a second momentary position of engagement at which the follower exposes the cam openings;

a third elongated hollow member having an open end:

a brush having a plurality of essentially parallel bristles with powder applying tips, the brush being disposed in the open third member end, the brush carrying end of the third member being removably disposed in the second end of the second member and engaging the follower, the second member being slidable back and forth along the third member between a first normal position at which the cam and follower are in the first position of engagement and a second momentary position at which the cam and follower are in the momentary second position of engagement.

2. The dispenser and applicator of claim 1 wherein said first, second and third members are disposed end to end along a common longitudinal axis, the separation between said first and third members, as measured along said axis, being a maximum when the second member is in its first position and being a minimum when the second member is in its second position.

3. The dispenser and applicator of claim 2 wherein when the first and third members are subjected to compression force exerted along said axis, the separation between the first and third members is said minimum and when said force is not present, said separation is said maximum.

4. The dispenser and applicator of claim 3, wherein said cam has spaced slots and a head disposed therebetween, each slot containing one of the cam openings, and wherein said follower has a central hole engaged by said cam head and flexible arms, each arm slidably engaging the slots.

5. The dispenser and applicator of claim 4 wherein said arms cover the openings in the slots when the cam and follower are in the first engagement position and uncover these openings when the cam and follower are in the second engagement position.

* * * * *